United States Patent [19]

Gould

[11] 4,335,553

[45] Jun. 22, 1982

[54] BUILDING BLOCK SYSTEM

[75] Inventor: Gerald Gould, New Canaan, Conn.

[73] Assignee: Roger E. Gould, New Canaan, Conn. ; a part interest

[21] Appl. No.: 159,509

[22] Filed: Jun. 16, 1980

[51] Int. Cl.[3] ..... E04B 2/70; E04B 2/48

[52] U.S. Cl. ..... 52/375

[58] Field of Search ..... 52/372–375, 52/602, 351, 508, 563

[56] References Cited

U.S. PATENT DOCUMENTS

| | | | |
|---|---|---|---|
| 751,346 | 2/1904 | Schall | 52/375 |
| 1,451,000 | 4/1923 | White | 52/602 |
| 1,571,645 | 2/1926 | Rocic | 52/375 |
| 1,651,893 | 12/1927 | Jorgensen | 52/375 |
| 2,008,775 | 7/1935 | Staman | 52/374 |
| 2,049,907 | 8/1936 | Hess | 52/375 |
| 2,700,294 | 1/1955 | Banneyer | 52/351 |

FOREIGN PATENT DOCUMENTS

| | | | |
|---|---|---|---|
| 934715 | 1/1948 | France | 52/375 |
| Ad.55232 | | | |

*Primary Examiner*—James L. Ridgill, Jr.
*Attorney, Agent, or Firm*—Cesari and McKenna

[57] ABSTRACT

A building block system comprised of three basic blocks. A first block has the shape of a rectangular prism and is of a more or less standard cinder block design. A second block has a main body portion that is similar in size and shape to the first block. The second block also includes a pair of spaced apart, mirror image protrusions that extend outwardly from one of the vertical faces of the main body portion. The protrusions define a vertical channel that is laterally centered on the second block. A third block also has a main body portion similar in size and shape to the first block. The third block also includes a pair of spaced apart protrusions extending from one of the vertical faces of its main body portion. The protrusions on the third block are laterally offset to one end of the block. The blocks can be stacked together end-to-end and in courses to form rigid, load-bearing structures. By using the second and third blocks alternately in adjacent courses, the protrusions thereon can be vertically aligned to define vertical channels extending from course to course. The vertical channels can accommodate facing studs, reinforcing members, electrical or plumbing runs, and the like. The blocks also define vertical passages that serve as dead air space, as space for insulation or as air flow passages for thermal siphoning effects. Any of a variety of structures may be formed.

7 Claims, 11 Drawing Figures

BUILDING BLOCK SYSTEM

BACKGROUND OF THE INVENTION

This invention relates to a building system. It relates more particularly to a building system that utilizes both standard and specially designed preformed blocks that readily permit the construction of high strength, low heat transmission wall structures capable of accommodating a variety of interior and exterior finishes.

It is evident, from the rapidly and ever-increasing cost of construction, that new and improved building systems are required which can reduce the cost of building materials and reduce the cost of labor required to assemble the materials into finished structures. Cost reduction, however, is not the only consideration in the design of modern day building systems. With our sources of energy constantly diminishing and with the costs of heating and cooling finished structures rising at alarming rates, it is clear that new building systems must also possess good insulative properties. New building systems should also be relatively easy to assemble and construct, and not require the possession of new or special skills on the part of the individuals who assemble them. Although ease of construction is always an important consideration, it is particularly important in the relatively underdeveloped parts of the world where skilled labor is scarce. Other important considerations include strength of construction, flexibility of construction in terms of the designs, shapes and kinds of structures that can be erected with the building system, and the esthetic appearance of the finished structures.

A wide variety of specially designed building systems have been proposed by others heretofore. However, few of these systems has gained any degree of commercial success. A major reason for this lack of acceptance is that most prior building systems involve trade-offs among the important considerations discussed above. For example, many low cost systems do not possess good insulative properties, high strength or flexibility of construction. Those systems that possess good insulative properties are very often relatively high in cost and relatively difficult to construct, requiring new and special skills on the part of the assemblers. Further, many high strength systems are not particularly attractive as they are limited in terms of the types of finish materials that can be used therewith. There is thus a real need in the art for a new and improved building system that combines low cost, low heat transmission, high strength, flexibility and ease of construction, and an attractive appearance.

OBJECTS OF THE INVENTION

It is, therefore, a broad object of this invention to provide a new and improved building system of the type described above that features low cost, low heat transmission, high strength, flexibility and ease of construction, and an attractive appearance.

A more specific object of the invention is to provide a new and improved building system comprised of both standard and specially designed preformed blocks, of concrete, cinder or other known suitable material, wherein the specially designed blocks, consisting only of relatively straightforward modifications of the standard blocks, can be fabricated using essentially the same techniques that are now used for the fabrication of standard blocks.

Another object of the invention is to provide a new and improved building system of the type described that can be assembled by individuals with only minimal training or experience in conventional masonry construction techniques.

Another object of the invention is to provide a new and improved building system of the type described that provides substantial space in the finished structures that can serve as dead air spaces, air flow passages or that can accommodate insulation of any of the known kinds. The vertical passages may also be utilized for electrical or plumbing raceways.

Another object of the invention is to provide a new and improved building system of the type described that provides vertical channels in the finished structures for accommodating reinforcing members, studs for the attachment of facing materials such as sheet rock, paneling or the like, or combinations of the above. The vertical channels may also be utilized for electrical or plumbing raceways.

Other objects will in part be obvious and will in part appear hereinafter.

SUMMARY OF THE INVENTION

In general, a building system embodied according to the invention is comprised of a plurality of preformed structural units which are stacked together end-to-end and in courses to form the desired finished structures. Each structural unit is a preformed block of concrete, cinder or other comparable material capable of withstanding high compression forces. A basic system embodied according to the invention is comprised of three such blocks, each of a slightly different form. A first of the three basic blocks is of more or less standard shape and design. For example, the first block may have the shape of a rectangular prism, with a length about twice its width and height, with flat bottom, top and side faces, and with one or more through-openings extending vertically between its top and bottom faces. A second of the three basic blocks includes a main body portion that is substantially identical in size, shape and design in the first block. However, a pair of mirror-image protrusions extend outwardly from at least one of the side faces of the second block. The protrusions are spaced apart from one another and positioned so as to define a vertical channel that is laterally centered with respect to the side face from which they protrude. The protrusions are preferably formed integrally with the main body portion of the second block and tapered in thickness for improved strength. A third of the three basic blocks is similar to the second block in that it includes a main body portion that is substantially identical to the first block and a pair of spaced apart protrusions extending outwardly from at least one of its side faces. However, unlike those in the second block, the protrusions in the third block are positioned so as to define a vertical channel that is laterally offset to one end of the side face from which they protrude.

Any of a variety of structures may be constructed by stacking the blocks together end-to-end and in courses. Preferably, the blocks in adjacent courses are laterally displaced relatively to one another so that the vertical joints between the blocks are laterally staggered from course to course. By using the second and third blocks of the basic system alternately from course to course, none of the joints between the blocks in any three consecutive courses is vertically aligned. This staggering of the joints inhibits the progragation of cracks along the joints. In conventional cinder block constructions, the joints in every other course are vertically aligned. The three course joint staggering of the present invention provide greater resistance to cracking than such conventional constructions.

Further, by using the second and third blocks alternately from course to course, the protrusions extending from the side face thereof can be readily aligned one above the other so as to define a vertical channel that extends from course to course in the structure. These vertical channels can then be used to accommodate reinforcing members, studs, or combinations of the above. The studs in the vertical channels provide a convenient means for fastening a facing layer, such as paneling, sheetrock or the like, to the structure. The facing layer defines a plurality of vertical passages between adjacent pairs of the protrusions which may serve as dead air spaces, as air flow passages, or in which insulation may be installed. The first, or standard, blocks may be used in the structure wherever it is desired to increase the lateral spacing between the vertical channels.

Features of the type described above that are possible with the present building system were heretofore available essentially only in poured concrete structures. The building system of the invention, however, eliminates the need for constructing wood or other forms for the poured concrete, and thus does not require the services of a skilled carpenter during assembly.

The blocks may be assembled by conventional means, for example, using cement or mortar in the joints between the blocks. The blocks, however, can also be assembled dry (i.e., without cement or mortar) with the reinforcing members in the vertical channels defined by the protrusions serving to prevent lateral shifting of the blocks. When the blocks are assembled dry, the exposed surfaces of the structure may be stuccoed with, for example, a high strength, synthetic cement to provide waterproofing and reinforcement and an esthetically pleasing appearance. By butting the protrusions of one block against the side face of the protrusions of another block, double thickness walls and other structures, such as chimney flues can be erected. Further, the blocks can be modified to include protrusions of the above described type extending outwardly from both opposed side faces of the block rather than from only one side face thereof. Such a modification facilitates the attachment of facing layers to both sides of the finished structure.

BRIEF DESCRIPTION OF THE DRAWINGS

The foregoing and other objects, features and advantages of the invention will be better understood from the following detailed description taken in conjunction with the accompanying drawing in which.

DETAILED DESCRIPTION OF ILLUSTRATIVE EMBODIMENTS

Figure 2:
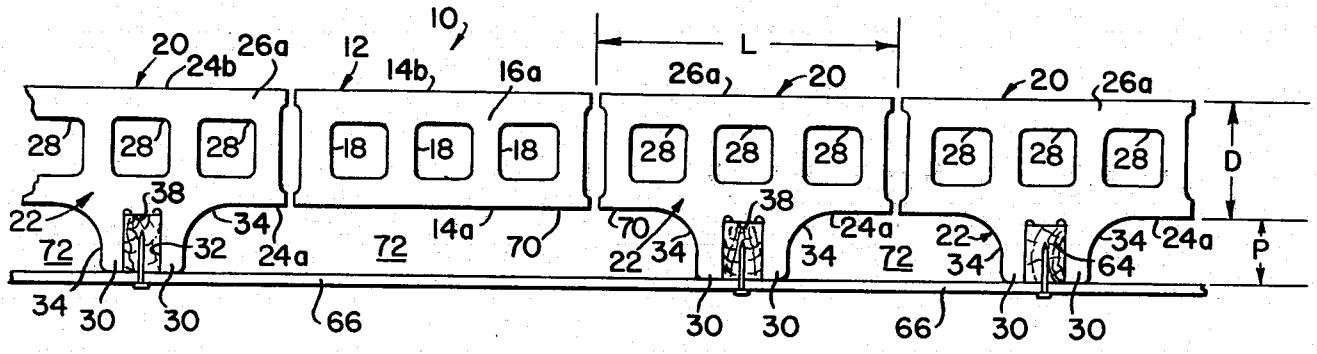
FIG. 2 is a top view of the wall structure shown in FIG. 1.
Figure 1:
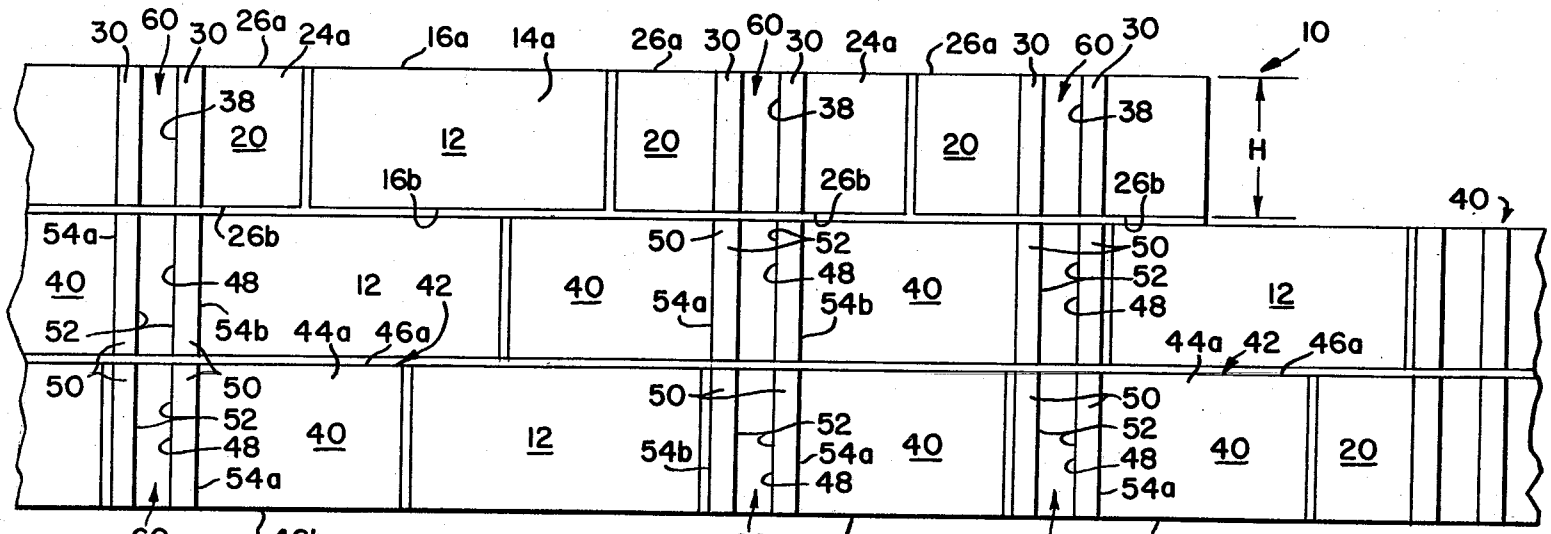
FIG. 1 is an elevational view of a wall structure constructed using a building system embodied in accordance with the invention.

Referring now specifically to the drawing, and initially to FIGS. 1 and 2 thereof, there is shown a wall structure 10 constructed of a number of basic, performed building units or blocks which are stacked end-to-end and on top of one another in courses. The blocks in the wall structure 10, which are formed of a concrete aggregate or other comparable material, are of three basic types. The blocks labelled 12 have a standard design of the type conventionally used in concrete or cinder block construction. The blocks 12 have the shape of a rectangular prism with planar vertical faces 14*a* and 14*b*, planar top and bottoms faces 16*a* and 16*b*, respectively, and a number of openings 18 extending vertically therethrough. The length of each block 12 is typically greater than its width and its height. The actual dimensions of the blocks 12 may, of course, vary depending upon the type of construction involved. If a conventional 16 inch center-to-center cinder block system is to be followed, the blocks 12 would have a length slightly less than 16 inches (i.e., 15.66 inches). The height and thickness of the blocks 12 may be any relative dimension, such as, for example, about 8 inches.

The blocks labelled 20 in FIGS. 1 and 2 are specially designed units having a main body portion 22 that is substantially identical in size, shape and design to the blocks 12. The blocks 20 thus also have planar vertical faces 24*a* and 24*b*, planar top and bottom faces 26*a* and 26*b*, respectively, and a number of openings 28 extending vertically therethrough. Formed integrally with and extending outwardly from the vertical face 24*a* of each block 20 is a pair of spaced apart, mirror-image protrusions 30. The protrusions 30 have inside faces 32 that extend at a right angle to the vertical face 24*a*, and outside faces 34 that are curved, thus giving the protrusions 30 a tapered, high strength shape. As can be appreciated from FIG. 2, the protrusions 30 are laterally centered relative to the ends of the block 20. The protrusions 30 thus define a vertical channel 38 centered on the block 20. The protrusions 30 may extend outwardly from the vertical face 24*a* through any desired length. A protrusion extension length of about 3.5 inches is compatible with conventional studding sizes and insulation thicknesses, as explained more fully hereinbelow.

The blocks labelled 40 in FIGS. 1 and 2 are also specially designed units having a main body portion 42 that is substantially identical in size, shape and design to the blocks 12. The blocks 40 have planar vertical faces 44*a* and 44*b*, planar top and bottom faces 46*a* and 46*b*, respectively, and a number of openings (not shown) extending vertically therethrough. Each block 40 also has a pair of spaced apart, integral protrusions 50 extending outwardly from its vertical face 44*a*. Like the protrusions 30 in the blocks 20, the protrusions 50 in the blocks 40 have inside faces 52 that extend at a right angle to the vertical face 44*a*, a first outside face 54*a* that is curved and a second outside face 54*b* that is also at a right angle to the vertical face 44*a*. Unlike the protrusions 30, however, the protrusions 50 in the block 40 are laterally offset to one end of the block 40. Thus, the protrusions 50 define a vertical channel 48 on one side of the block 40 laterally offset from its center. The protrusions 50 may also have an extension length of about 3.5 inches.

As can be appreciated from FIGS. 1 and 2, the blocks 12, 20 and 40 are stacked end-to-end and in courses in the wall structure in such a manner that the vertical channels 38 and 48 of the blocks 20 and 40, respectively, in different courses are aligned above one another. The individual channels 38 and 48 thus combine to define vertical channels 60 extending from course to course in the structure 10. The spacing between the vertical channels 60 can be made equal to the length of one block (e.g., approximately 16 inches) by using only the blocks 20 and 40 in the courses, as indicated in the center portion of the wall structure 10 shown in FIG. 1. The spacing between the channels 60 can also be increased by combining the standard blocks 12 with the blocks 20 and 40, as indicated in the right-hand portion and left-hand portion of the wall structure 10 of FIG. 1.

As is seen in FIG. 1, the vertical joints between adjacent blocks are staggered laterally from one another as one progresses upwardly along the structure 10 from course to course. In fact, with the system of this invention, none of the vertical joints in any three consecutive courses end up vertically aligned. This lateral staggering of the joints over three consecutive courses helps inhibit the progragation of cracks in the structure. Even in conventional cinder block constructions, the vertical joints in every other course are vertically aligned.

As shown in FIG. 2, the vertical channels 60 in wall structure 10 can accommodate vertical members such as wooden studs 64 which provide a convenient means for the fastening of a facing layer 66 to the structure 10. The wooden studs 64 may be standard 2 by 4 inch lumber, thus accounting for the above-mentioned 3.5 inch extension length on the protrusions 30 and 50. Because of the protrusions 30 and 50, the facing layer 66 also defines, with the blocks 12, 20 and 40 in the structure 10, a plurality a spaced vertical passages 70. The passages 70 can conveniently accommodate insulation 72 which may be in roll, bolt, granular, foam or any other form. The depth of the vertical passages 70 is about 3.5 inches because of the above mentioned extension lengths of the protrusions 30 and 50. The passages 70 can thus accommodate standard thicknesses of insulation. Where double thickness insulation is desired or increased insulation plus dead air space, the protrusions may be increased to $5\frac{1}{2}$ for $2'' \times 6''$ vertical members or any length in between. The vertical channels 60 and vertical passages 70 also provide a convenient area for locating and concealing electrical and plumbing runs (not shown) in the structure 10.

Figure 3A:
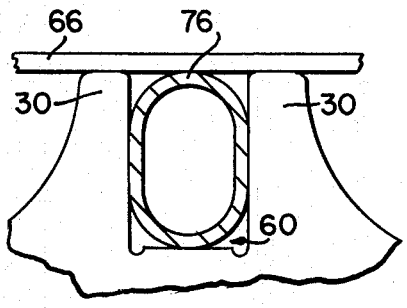
FIGS. 3A through 3F are top views of a block embodying the invention in combination with various different vertical reinforcing members.
Figure 3B:
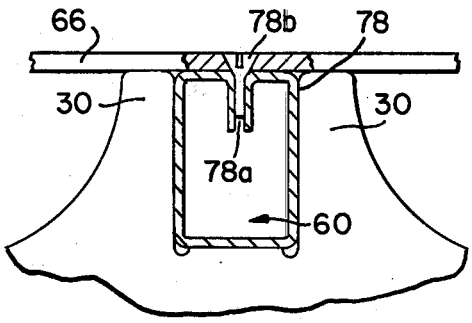
Figure 3C:
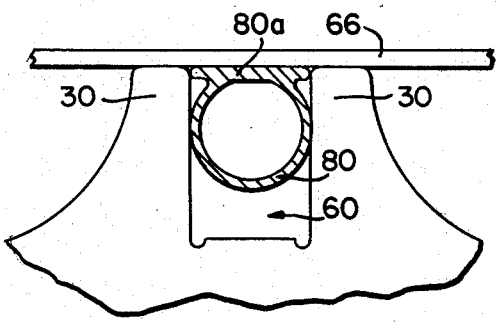

The blocks 12, 20 and 40 can be assembled together using conventional means e.g., by cementing or mortaring their joints. Alternatively, the blocks 12, 20 and 40 can be assembled dry. It is preferred, particularly where the blocks are assembled dry, that members be installed in the vertical channels 60 of sufficient strength to resist lateral shifting of the blocks 12, 20 and 40 relative to one another. FIGS. 3A and 3F illustrate various alternative reinforcing members effective for this purpose.

FIG. 3A illustrates a reinforcing member in the form of a flattened tube 76 of metal or the like, which may be force-fit or otherwise retained in the channel 60. In FIG. 3B, the reinforcing member is in the form of a rectangular raceway 78, again of metal or the like, which has a cross-sectional shape matching that of the channel 60 and which may be provided with one or more openings **78*a* for receiving bolts or screws 78*b* used to attach the finish layer 66. In FIG. 3C, the reinforcing member is in the form of a specially shaped extended tube 80 having a plate-like facing portion 80*a* which may also be force-fit in the channel 60**.

Figure 3D:
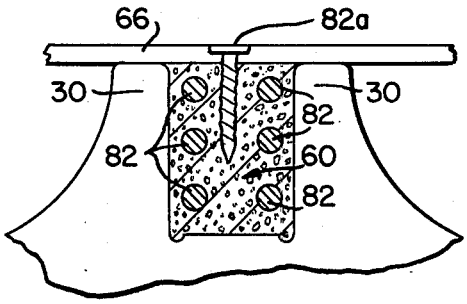

As indicated in FIG. 3D, the channel 60 may be filled with cement or other such material having vertical reinforcing rods 82 dispersed therein. In this case, the finish layer 66 can be secured using nails **82*a*** or other such fasteners designed for use in cement.

Figure 3E:
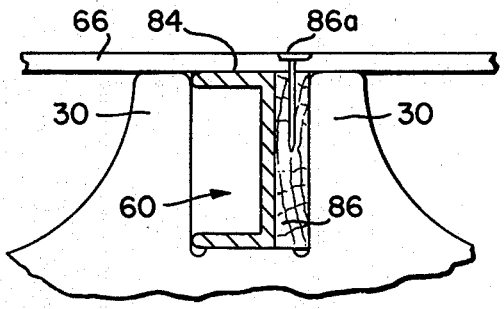
Figure 3F:
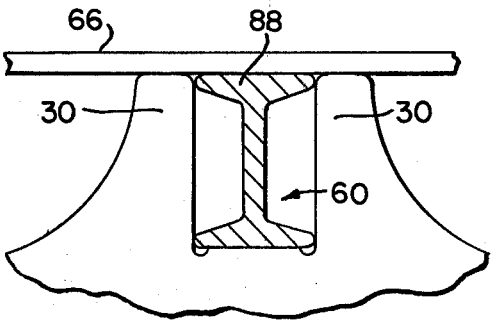

The reinforcing member in FIG. 3E is formed as a combination of a rigid beam or extension 84 and a wooden stud 86. The rigid beam 84, typically of metal, provides excellent strength and rigidity, while the wooden stud 86 permits the fastening of the finish layer 66 using nails **86*a*. FIG. 3F shows a simple rigid "I" beam 88 installed in the channel 60**.

Particularly in those cases where the blocks in the structure 10 are assembled dry, the exposed vertical surfaces of the structure 10 may be stuccoed with a suitable substance to help prevent relative shifting of the blocks, to waterproof the structure 10, and/or to improve its esthetic appearance. Conventional stuccoing mortar may be used for this purpose. Alternatively, high strength synthetic cements, such as glass fiber re-enforced synthetic cements, may be used for this purpose, e.g., the cement available under the trade name "Sure Wall" from Best Block, Inc. of Edison, N.J., or the cement available under the trade name "Structural Skin" from Conproco, Inc. of, New Hampshire. Such high strength synthetic cements retain some degree of flexibility even after setting, and thus resist cracking due to shifting of the structure 10.

Figure 4:
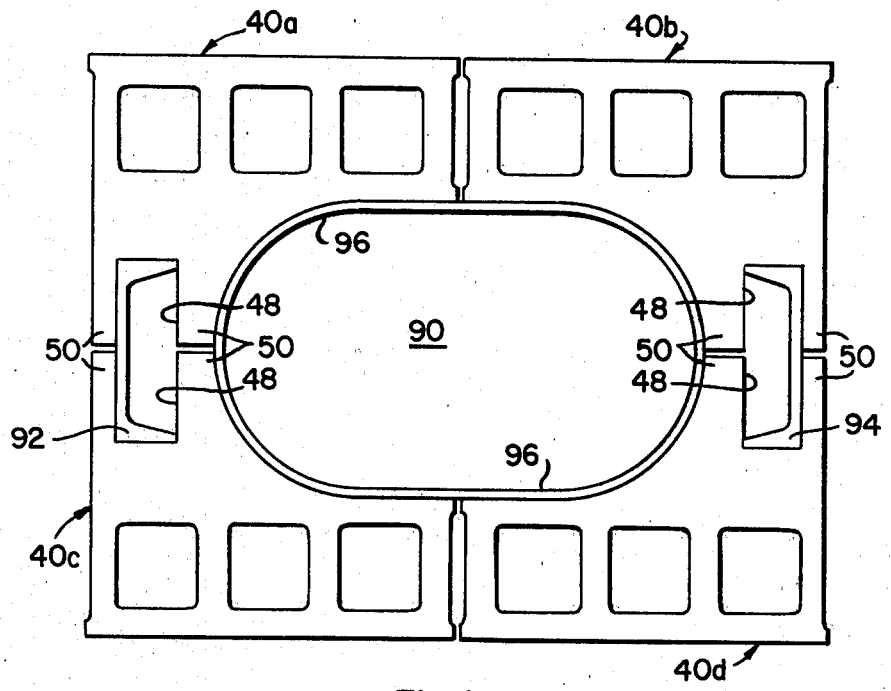
FIG. 4 is a top view of a chimney flue structure constructed using the building blocks of the invention.

FIG. 4 of the drawing illustrates how the blocks 40 can be assembled to construct a chimney flue 90 or like structure. As indicated in FIG. 4, each course of the flue 90 is composed of four of the blocks 40, which have been labelled **40*a*, 40*b*, 40*c* and 40*d*. The blocks 40*a* and 40*c* and the blocks 40*b* and 40*d*, respectively, are oriented with their protrusions 50 facing each other. The blocks 40*a* and 40*b* and the blocks 40*c* and 40*d*, respectively, are oriented end-to-end. The blocks 40*a*, 40*b*, 40*c* and 40*d* thus define closed structure which is open at its center. The facing channels 48 of the block 40*a* and 40*c* accommodate a single reinforcing member such as metal beam 92. A second metal beam 94 is positioned in the facing channels 48 of the blocks 40*b* and 40*d*. If desired, the inside surface of each of the blocks 40*a*, 40*b*, 40*c* and 40*d* may be faced or glazed, as indicated at 96 in FIG. 4**, for fireproofing or sealing purposes.

Figure 5:
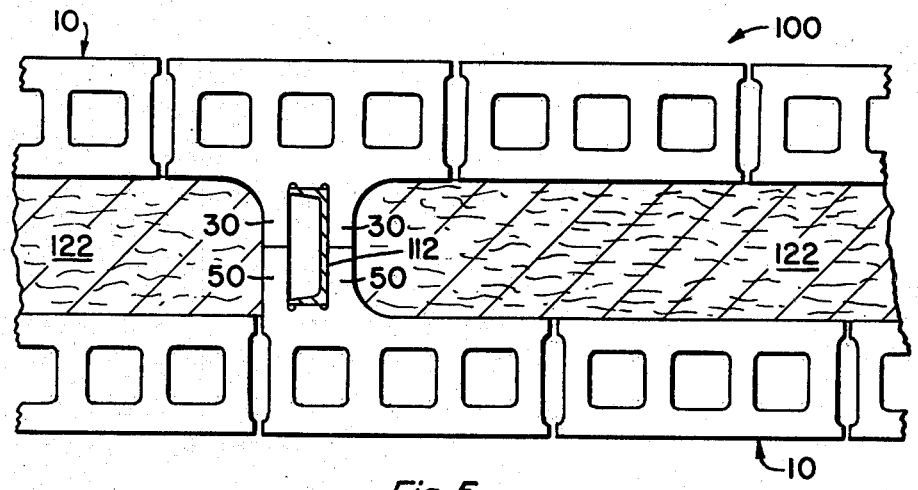
FIG. 5 is a top view of a double thickness wall structure constructed using the building blocks of the invention.

FIG. 5 is a top view of a double thickness wall structure 100. The structure 100 is comprised of two of the wall structures 10 shown in FIGS. 1 and 2 disposed adjacent one another and with the protrusions 30 and 50 of the blocks 20 and 40, respectively, in a butting relationship. The double thickness structure 100 defines enlarged vertical channels 110 for receiving reinforcing members 112 and enlarged vertical passages 120 for providing dead air space or accommodating insulation 122 or the like.

Figure 6A:
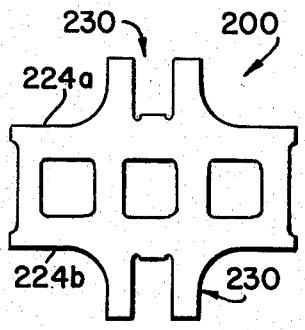
FIGS. 6A and 6B are top views of modified building blocks embodying the invention, particularly useful in a structure to have facing layers on both of its sides.
Figure 6B:
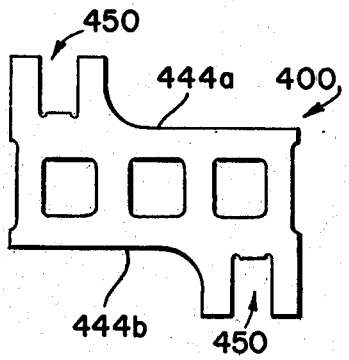

FIG. 6A illustrates a modified block 200 which is similar to the block 20 previously described but which has protrusions 230 extending outwardly from both of its side faces **224*a* and 224*b*. FIG. 6B shows a modified block 400 which is similar to the block 40 previously described but which also has protrusions 450 extending outwardly from both of its side faces 444*a* and 444*b*. As will be apparent, the blocks 200 and 400** are useful in the construction of wall structures both sides of which are to receive facing layers and to have vertical channels.

In summary, the building system described above and embodied in accordance with this invention combines a large number of attractive features. The protrusions 30 and 50 on the blocks 20 and 40 conveniently define vertical channels 60 in the structure 10 for receiving studding, reinforcing members or other standard or specially designed members. The protrusions 30 and 50 also conveniently define vertical passages 72 that provide an insulating dead air space, room for standard insulation materials, and/or room for electrical or plumbing raceways to be concealed within the structure 10. These features are typically provided in conventional cinder block or other building systems through the implementation of extensive carpentry framing. With the system of the present invention, little if any carpentry is required, thus eliminating the need for skilled carpentry craftsmen in its construction.

The protrusions 30 and 50 also facilitate the positioning and alignment of the blocks 12, 20 and 40 relative to one another during assembly of the structure 10. Thus, the assembler need have only minimal skill, training or experience in the construction of masonry type structures.

The blocks 12, 20 and 40 can also be fabricated using standard techniques which permits their economic production in large quantities. Further, the blocks 12, 20 and 40 permit any of a wide variety of different structures to be formed, including closed structures, such as chimney flues, double thickness walls, and the like.

Features of the above type were heretofore conveniently achievable only with poured concrete systems. Poured concrete systems, however, are disadvantaged because of the need for equipment and facilities to mix and deliver the concrete and for complicated forms to contain the concrete while it is setting. The building system should thus be particularly attractive to small builders and in areas where the facilities for delivery of poured concrete are expensive or inadequate.

It should be understood that the foregoing description is intended to illustrate rather than limit the invention, and that numerous modifications may be made to the specifically described embodiments by those skilled in the art without departing from the scope of the invention as defined by the appended claims. For example, the vertical passages 72 in the structure 10 can readily be used as air flow passages to create a thermal siphoning effecting in the structure 10 for the warming and circulation of the warmed air to the interior of the structure. In such a case, the facing layer 66 of FIG. 2 could be a transparent sheet material such as glass or transparent plastic. The structure 10 would be oriented so that the facing layer 66 is directed to receive the warming rays of the sun (i.e., have a southern exposure). Blocks would be eliminated or openings otherwise provided near the base of the structure 10 and also near the top of the structure 10 in communication with the vertical passages 72. Cooler air from the interior of the structure 10 would then enter through such openings in the base of the structure 10 and be warmed by the rays of the sun. The air, as it is warmed, becomes lighter and rises through the passages 72 and is conducted back into the interior of the structure 10 through the openings near the top of the structure 10. The warm air and rays of the sun also warm the blocks in the structure which absorb and retain the heat. In the low sun hours, the transparent facing layer 66 could be covered with a removable insulative outer covering which prevents the escape of heat. The warmed blocks in the structure 10 thus continue to provide heat to the interior for limited times during low sun hours. Structures of this type, readily achievable using the building system of the invention, provide improved heating efficiencies and minimizes demands on auxiliary heating systems even in cold climates.

Additionally, although the blocks 12, 20, 40, 200 and 400 have been shown and described above as having similar, rectangular shapes, the shapes of the blocks can be varied. For example, the blocks could also be arcuate in shape and therefore useful in the construction of contoured structures. The end faces of the blocks could also be skewed at angles relative to the long axes of the blocks so that the blocks can be butted end-to-end to define miter-like corners. Other useful modifications will suggest themselves to those skilled in the art.

What I claim as new and desire to secure by Letters Patent of the United States is:

1. A building system comprised of a plurality of rigid, preformed building units, said building units including A. a first block having a main body portion including first and second vertical faces, top and bottom parallel faces and first and second end faces, said first block further including means defining a pair of spaced apart protrusions extending outwardly from at least one of said vertical faces of said main body portion, said protrusions defining a vertical channel that is laterally centered on said one vertical face between said first and second end faces;

B. a second block having a main body portion including first and second vertical faces, top and bottom parallel faces and first and second end faces, said second block further including means defining a pair of spaced apart protrusions extending outwardly from at least one of said vertical faces of said second block main body portion, said second block protrusions defining a vertical channel that is laterally offset on said one vertical face toward the one of said first and second end faces disposed to the left of said one vertical face; C. a third block having a main body portion including first and second vertical faces, top and bottom parallel faces and first and second end faces, said third block further including means defining a pair of spaced apart protrusions extending outwardly from at least one of said vertical faces of said third block main body portion, said third block protrusions defining a vertical channel that is laterally offset on said one vertical face toward the one of said first and second end faces disposed to the right of said one vertical face;

D. said first, second and third blocks being stackable end-to-end and in courses to form rigid, load-bearing structures including at least one sequence of three courses in which said first blocks are disposed in one of said courses of said sequence, said second blocks are disposed in another of said courses of said sequence with their protrusion defining means aligned with those of said first blocks, and said third blocks are disposed in the remaining course of said sequence with their protrusion defining means aligned with those of said first and second blocks so as to define vertical channels that extend from course-to-course in said structure, said end faces of said first, second and third blocks in said sequence of three courses thereby being offset from each other.

2. A building system as defined in claim 1 in which said main body portions of said first, second and third blocks include means defining at least one opening extending vertically therethrough between the top and bottom faces thereof.

3. A building system as defined in claim 1 in which said protrusion defining means in said first block defines spaced apart, mirror image protrusions having opposed inwardly looking faces at right angles to said one of said vertical faces from which they protrude and outwardly looking faces that are curved so that the protrusions taper in thickness away from said one vertical face from which they protrude.

4. A building system as defined in claim 1 in which said protrusion defining means in said second and third blocks define spaced apart protrusions having opposed inwardly looking faces at right angles to said vertical faces from which they protrude, first outwardly looking faces adjacent said left and right end faces of said second and third block main body portions, respectively, and second outwardly looking faces that are curved so that the ones of said pairs of protrusions associated with said second outwardly looking faces are tapered in thickness away from said vertical faces from which they protrude.

5. A building system as defined in claim 1 further including reinforcing members positioned on the vertical channels defined by the vertically aligned protrusions and extending from course-to-course in said structure to help prevent lateral shifting of said first, second and third blocks relative to one another.

6. A building system as defined in claim 1 further including studding members positioned in the vertical channels defined by the vertically aligned protrusions and extending from course-to-course in said structure, a facing layer overlaying said blocks and positioned against the protruding ends of the protrusions, said facing layer being fastened to said structure by attachment to said studding members.

7. A building system as defined in claim 1 in which said protrusion defining means in said first, second and third blocks define a pair of spaced apart protrusions extending outwardly from both of said vertical faces of said main body portions.

* * * * *